United States Patent [19]

Takamiya et al.

[11] Patent Number: 4,618,298

[45] Date of Patent: Oct. 21, 1986

[54] METHOD FOR CONSTRUCTING AN ENLARGED TUNNEL AND APPARATUS FOR FORMING THE SAME

[75] Inventors: Shigeo Takamiya; Kazutoshi Inoue; Kenzo Tsutaya, all of Tokyo, Japan

[73] Assignee: Mitsui Kensetsu Kabushiki Kaisha, Tokyo, Japan

[21] Appl. No.: 595,406

[22] Filed: Mar. 30, 1984

[30] Foreign Application Priority Data

Mar. 30, 1983 [JP] Japan ..... 58-54635

[51] Int. Cl.[4] ..... E21D 11/00; E21D 9/06

[52] U.S. Cl. ..... 405/150; 405/146; 405/138

[58] Field of Search ..... 405/138–146, 405/150, 151, 132; 175/53, 61, 62, 350, 319, 262, 264, 108; 299/31, 33

[56] References Cited

U.S. PATENT DOCUMENTS

| | | | |
|---|---|---|---|
| 1,278,932 | 9/1918 | Hughes | 175/62 X |
| 2,743,087 | 4/1956 | Layne et al. | 175/350 X |
| 2,903,252 | 9/1959 | Ebeling | 175/53 |
| 3,523,426 | 8/1970 | Lauber | 299/31 X |
| 4,530,621 | 7/1985 | Furuta et al. | 405/150 |

FOREIGN PATENT DOCUMENTS

| | | | |
|---|---|---|---|
| 459285 | 9/1968 | Switzerland | 405/141 |

OTHER PUBLICATIONS

Publication entitled "Explanation of Shield Driving Process for Enlargement, " Jul., 1982.

*Primary Examiner*—Dennis L. Taylor

*Attorney, Agent, or Firm*—Birch, Stewart, Kolasch & Birch

[57] ABSTRACT

A method and apparatus for constructing an enlarged tunnel in a portion of a predetermined region of an existing tunnel. A circumferentially enlarged portion is excavated to define a starting base for a shield machine. The shield machine is positioned in the circumferentially enlarged portion and advanced forward along the existing tunnel in order to enlarge the circumference in the predetermined region of the existing tunnel. A section of a tubular liner lining the existing tunnel is broken and removed therefrom. Thereafter, the resultant enlarged tunnel portion is lined with segments.

13 Claims, 14 Drawing Figures

METHOD FOR CONSTRUCTING AN ENLARGED TUNNEL AND APPARATUS FOR FORMING THE SAME

BACKGROUND OF THE INVENTION

1. Field of the Invention

This invention relates to a method for constructing a circumferentially enlarged tunnel in a predetermined region of an existing tunnel, and to an apparatus for constructing the enlarged tunnel. More specifically, the invention is directed to the method and the apparatus for constructing a circumferentially enlarged tunnel in a predetermined region of an existing tunnel covered with a tubular liner such as a Hume concrete pipe or a concrete liner.

SUMMARY AND OBJECTS OF THE INVENTION

It is an object of the present invention to construct any desired enlarged tunnel in a predetermined or middle region of any of a variety of types of the existing tunnels lined with a tubular liner such as a segment ring type assembly liner, a Hume concrete pipe of a concrete tubular liner or the like formed by any conventional process such as a shield driving process or any other type of process.

It is a further object of the present invention to reduce or eliminate the working necessary for excavation of the shaft or the working necessary for refilling the same with ground soil. The assembling, installation and disassembling of the shield machine for enlargement of the existing tunnel is facilitated as compared with the conventional process and construction work for enlargement becomes very efficient and construction costs for the same can be decreased.

The present invention permits the breaking of the tubular liner which is carried out in the shield machine for enlargement, so as to prevent any collapsing of the ground soil during the breaking operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A method for excavating an enlarged tunnel through a predetermined middle region of an existing tunnel, has already been proposed by the assignee of the present invention. A summary of this method will be explained with reference to FIGS. 1–3.

Figure 1:
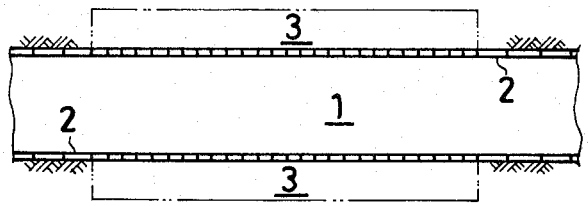
FIGS. 1–3 are sectional views showing a previously proposed driving shield process for enlargment of an existing tunnel.
Figure 2:
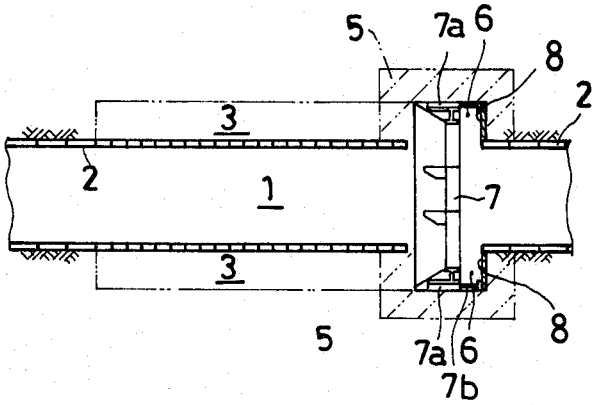

Referring to FIG. 1, an existing tunnel 1 is lined with segments 2 throughout a predetermined region 3 to be enlarged. A circumferentially enlarged portion 6 is formed at one end of the predetermined region 3 to be enlarged for using as a starting base for a shield machine by using any desired excavation means, as shown in FIG. 2.

In a case where the ground is soft, the ground where the starting base is to be constructed is changed into a reinforced area 5 by charging a reinforcing chemical liquid thereinto or any other reinforcing method. In addition, a steel retaining plate 8 is fixed to a proper part of the inner circumferential surface of the circumferentially enlarged portion 6. Further, in the circumferentially enlarged portion 6 used for the starting base there is assembled and provided a shield machine 7 for excavating an enlarged tunnel.

The shield machine 7 is provided with a hood-type driving crusher means 7*a* having a cutter head comprising circumferentially arranged plural cutters projecting forward from the periphery of the shield machine 7. Jack means 7*b* are provided comprising circumferentially arranged plural jacks serving to drive forward the foregoing crusher means 7*a* as a result of the jack means 7*b* receiving a reaction from the retaining steel plate 8 annularly fixed to the rear side surface of the circumferentially enlarged portion 6.

Figure 3:
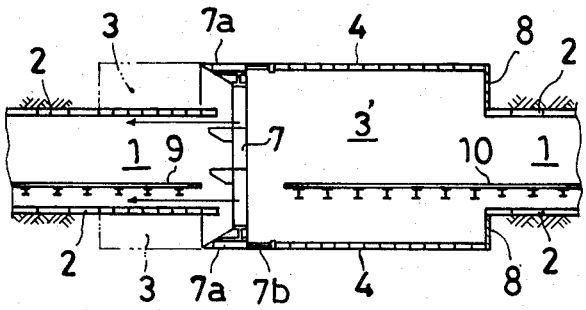

FIG. 3 shows an excavating operation of the foregoing shield machine 7 which is being driven forward. The shield machine 7 is driven forward by receiving the subsequent reaction so as to excavate a circumferentially enlarged tunnel, while the segments 2 lining the existing tunnel 1 are being removed by a removing means not shown. New segments 4 are applied to the circumferential surface of an enlarged tunnel portion 3' formed behind the advanced shield machine 7.

The resultant circumferentially enlarged tunnel portion 3' thereafter formed as the shield machine 7 is advanced is lined with segments 4. The forward driving of the shield machine 7 can be obtained through its jack means 7*b* pushing against the new segments 4. In this way, the step by step forward driving of the shield machine 7 for enlargement of the existing tunnel 1 while removing the segments 2 by means of disassembly thereof and the lining of new segments 4 are repeated until the excavation of enlargement of the predetermined region 3 of the existing tunnel 1 is completed.

A railway 9 is provided for a carrier carrying a removing means for removing the segments 2. In addition, a railway 10 is provided for another carrier carrying an erector for applying new segments 4 to the resultant enlarged tunnel portion 3'.

By the foregoing excavation process for enlargement of the existing tunnel, the work for excavating a shaft from the surface of the ground and the work for refilling the shaft with the ground soil as carried out by a conventional enlarged tunnel construction method is made unnecessary. The installation of the shield machine and disassembling thereof can be carried out easily, and also it is easy to obtain the reaction for driving the shield machine, so that as compared with the foregoing conventional enlarged tunnel construction method the circumferentially enlarged tunnel machine work becomes very efficient and also the construction costs can be decreased.

While utilizing the above proposed enlarged tunnel construction method, the present invention provides a method for constructing a circumferentially enlarged tunnel in a predetermined middle portion of an existing tunnel in order to be adaptable not only for an existing tunnel lined with segments, but also for an existing tunnel lined with a tubular liner formed out of a Hume concrete pipe or a concrete liner or the like that cannot be easily removed unlike the case in which the segments liner is removed by disassembling. A portion of a predetermined region of an existing tunnel to be enlarged is circumferentially enlarged by excavation so as to form a circumferentially enlarged portion which is utilized as a starting base for a shield machine. The shield machine is provided for enlargement in the circumferentially enlarged portion, and the shield machine is driven forward along the existing tunnel in order to enlarge the circumference of the predetermined region of the existing tunnel while a tubular liner lining the existing tunnel is broken away in the shield machine for enlargement. Thereafter, the resultant enlarged tunnel portion thus formed is circumferentially lined with segments.

According to another purpose of the present invention, an apparatus is provided for constructing an enlarged tunnel which makes it easy to perform the above enlarged tunnel construction method. The apparatus includes means for breaking a tubular liner lining an existing tunnel and a removing means for removing broken pieces of the tubular liner. A shield machine is provided for enlargment of the existing tunnel which is able to be assembled and disassembled and is provided with an excavating means and a jack means. An assembling means is provided for applying segments to the inner circumferential surface of the circumferentially enlarged portion.

A first embodiment of the present invention will be explained with reference to FIGS. 4, 5 and 5A–5D as follows. In this example, it is preferred that a tubular liner 12 lining an existing tunnel 11 is broken by being cut into segment pieces and then the segment pieces are removed.

Figure 4:
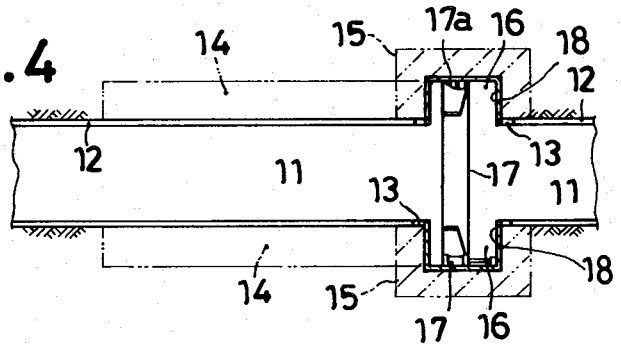
FIG. 4 is a sectional view showing a step for excavation of a circumferentially enlarged portion at one end of a predetermined portion of enlargement of an existing tunnel in a first example of the present invention.

Firstly, an excavation working for circumferential enlargement by any desired means is carried out at one end portion of a predetermined middle region of an existing tunnel 11 constructed by a driving shield process or the like and lined with a tubular liner 12 formed out of a Hume concrete pipe or a concrete liner or the like so that there may be formed a circumferentially enlarged portion 16 which is utilized as a starting base for a shield machine. Thereafter, there is provided in the circumferentially enlarged portion 16, as shown in FIG. 4, a shield machine 17 for enlargement for excavating the peripheral surface of the existing tunnel so as to be then driven forward to form the predetermined region 14 of the existing tunnel 11 into an enlarged tunnel 27. The shield machine 17 is constructed by plural units each comprising a driving cutter means 17*a* and a driving jack 17*b* assembled together into an annular form.

Prior to carrying out the excavation for making the circumferential enlarged portion 16 used for the starting base for the shield machine, part of the tubular liner 12 is circumferentially broken and removed by using, for instance, both a breaking machine and a removing machine which will be explained thereafter, or other means. Thereafter, a pair of guide rings 13, 13 are attached to the opposite circular ends of the resultant removed portion of the tubular liner 12 and the bottom of the exposed circumferential ground soil corresponding to the circumferentially broken portion of the tubular liner 12 being excavated. A circumferentially enlarging shield machine (not shown) is mounted therein to bridge between the rings 13, 13 and is driven in the circumferential direction so as to construct the circumferentially enlarged portion 16.

The foregoing circumferentially enlarging shield machine and the circumferentially excavating process for enlargement used thereby have been proposed in the U.S. patent application No. 558,973 filed Dec. 7, 1983, now U.S. Pat. No. 4,530,621, which is hereby incorporated by reference. Therefore, a detailed explanation is not necessary herein. The proposed shield machine comprises a nearly rectangular frame type cutter portion, a U-shaped frame type body portion and a jack means operatively connected thereto. An entire circle of the circumferential segments 18 is provided. All of these elements are illustrated in FIG. 4.

In a situation where the ground soil is soft, the same is changed into a reinforced area 15 by applying to the same a means for reinforcing the ground soil such as charging a reinforcing liquid agent or the like into the same before the foregoing circumferential excavation process is carried out.

A front plate of each of the circumferential segments 18 located ahead of the shield machine 17 for enlargement, installed in the circumferentially enlarged portion 16 as above, is removed. Temporarily, there is provided an annular pressure receiving member (not shown) between the shield machine 17 and rear plates of the circumferential segments 18. Each jack 17*b* of the shield machine 17 is extended to push the pressure receiving plate and accordingly drive forward step by step the shield machine 17 for enlargement by a predetermined distance. Thereafter, there is provided behind the shield machine 17 a cone-shaped pressure receiving member 19 fixed to the rear plates of the circumferential segments 18.

Figure 5:
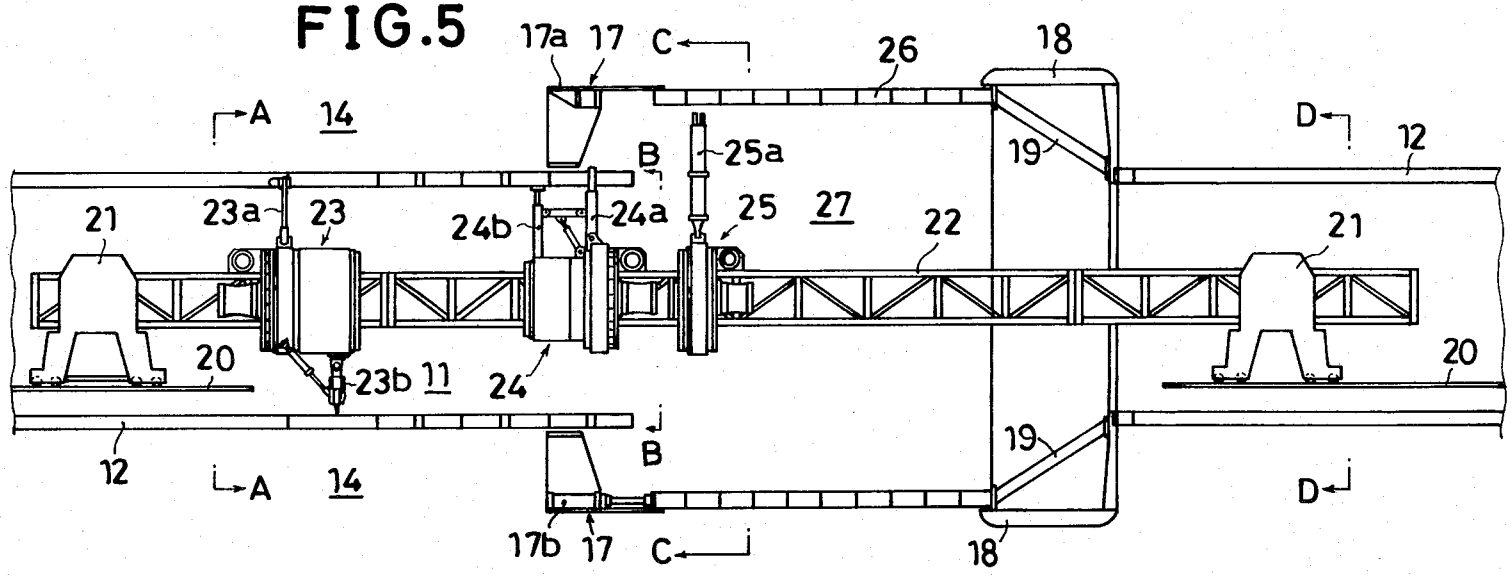
FIG. 5 is a sectional view showing the subsequent steps of the method of the present invention.
Figure 5A:
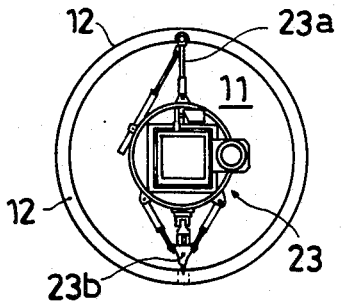
FIGS. 5A–5D are sectional views taken respectively along the lines A—A, B—B, C—C and D—D in FIG. 5.
Figure 5B:
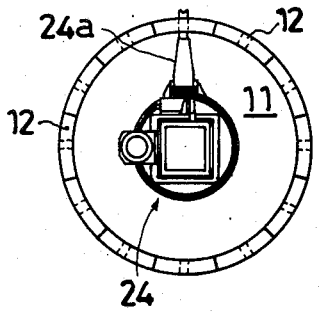
Figure 5C:
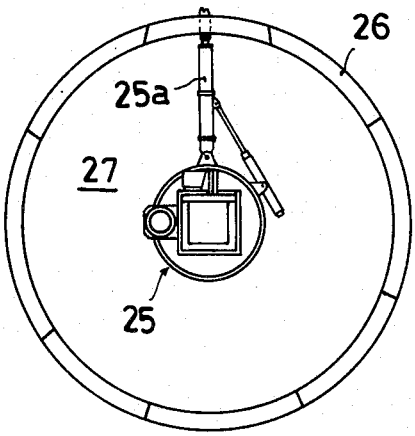
Figure 5D:
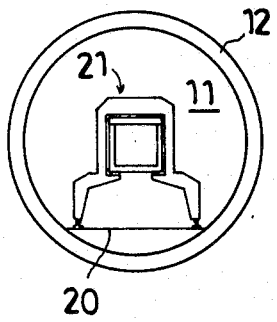

As shown in FIG. 5, respective railway lines 20, 20 are laid in the front and rear regions of the existing tunnel 11 located on both sides of the circumferential enlarged portion 16, and carriers 21, 21 are placed respectively on the railway lines 20, 20 so as to be movable thereon. A crossbeam bridged between the carriers 21, 21 is provided and a breaking means 23, a removing means 24 and an assembling means 25 are disposed in the middle portion of the cross beam 22 so as to be movable therealong.

The breaking means 23 is provided with arms 23*a* and 23*b* projecting therefrom in the lateral, that is, the diametrical direction. The arms 23*a* and 23*b* are arranged to be expandable and contractable and/or turnable by a jack or a motor or any other means. A rotary cutter is attached to the forward end of the arm 23*a* so as to be turnably positioned in the lateral direction or in the longitudinal direction so that the tubular liner 12 formed out of Hume concrete pipes or the like lining the circumferential surface of the existing tunnel 11 may be cut by the arm 23*a* into pieces in the form of segments. Thereafter, a hole is made in each segment piece by a drill attached to the forward end of the arm 23*b*.

The removing means 24 located in the rear of the breaking means is provided with arms 24*a* and 24*b* projecting therefrom in the lateral or diametrical direction. The arms 24*a* and 24*b* are to be contractable and expansible and also turnable by a jack, a motor or any other means so that a chuck attached to a forward end of the arm 24*a* may be inserted into the hole of the segment piece and be engaged therewith. The chuck is contracted, while the arm 24*b* connecting to the arm 24*a* is being pressed against the tubular liner 12, so as to remove the segment piece. In this way, every one of the encircled segment pieces is removed. The circumferential ground part of the predetermined region 14 to be enlarged around the existing tunnel 11 portion is excavated to be enlarged by the shield machine 17 before or simultaneously with the foregoing breaking of the tubular liner 12. Thus, the breaking of the tubular liner 12 is carried out in the shield machine for enlargement 17 so that collapsing of the ground soil during the breaking operation can be prevented.

With the progress of excavation of the circumferential ground of the predetermined region 14 to be enlarged by the advancing shield machine 17, the cross-beam 22 is moved forward through the carriers 21, 21 running on the rails 20, 20. The resultant circumferentially enlarged tunnel portion thus formed behind the advanced shield machine 17 is lined with segments 26 by the assembling erector 25. The assembling erector 25 for applying the segments 26 to the circumferential surface of the enlarged tunnel 27 is provided with an arm 25*a* projecting therefrom in the diametrical direction. The arm 25*a* is arranged to be expansible and contractable and also turnable by a jack, a motor or any other means so that the application of the segments 26 to the circumferential surface of the enlarged tunnel 27 may be carried out by a forward end of the arm 25*a*.

Further, in the foregoing process for making the enlarged tunnel 27 by the shield machine 17, the shield machine 17 is, in the first place, given a reaction from the cone-type pressure means 19 pressed by the jack means 17*b*. The shield machine 17 is driven forward so that the excavation of the ground soil around the existing tunnel 11 to be enlarged may be carried out by one stroke. After the excavation by one stroke is finished, the resultant enlarged tunnel portion thus formed behind the shield machine 17 is lined with the annular assembly of segments 26. Thereafter, the shield machine 17 is given a reaction from the annular segments 26 pressed by the jack means 17*b*. The shield machine is thereby driven forward by another one stroke. In this way, an enlarged tunnel 27 is constructed which extends over the entire length of the predetermined region 14 of the existing tunnel 11.

A number of breaking means can be considered with respect to the operation of the present invention. Some examples of breaking means are listed below:

1. Breaking by heat by using a flame jet, a laser beam, microwave, etc.

2. Breaking by water pressure using a water jet, a water jet mixed with silicate or garnet or the like, or other pressure medium, 3. Breaking by cutting or impact using a cutting arm, a breaker, drill, a concrete cutter or others, 4. Breaking by explosives using dynamite, concrete explosive means or the like, and 5. Breaking by expansible materials such as static breaking materials or the like.

Figure 6:
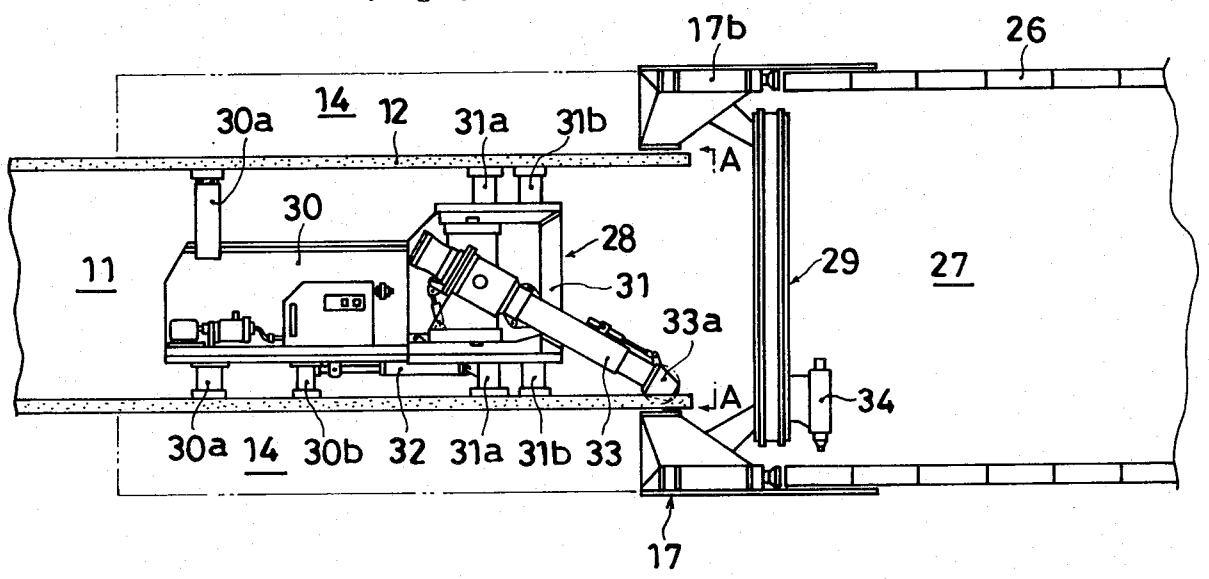
FIG. 6 is a sectional view for explaining a second example thereof.
Figure 6A:
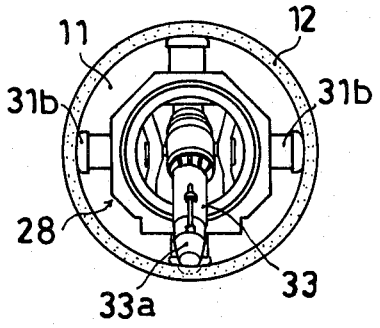
FIG. 6A is a sectional view taken along the line A—A in FIG. 6.

A second example of the present invention will be explained with reference to FIGS. 6 and 6A. In this example, the tubular liner 12 is broken without providing the foregoing removing means. The manner in which the circumferentially enlarged portion 16 used for the starting base is formed is the same as the steps utilized in the foregoing first example. Therefore, the explanation concerning these steps is omitted.

In the second example, a breaking means 28 and a ring-type erector 29 for assembling segments are disposed front and rear separately from one another. The tubular liner 12 for the existing tunnel 11 is broken in the shield machine 17 in advance thereto by the preceding breaking means 28. Thereafter, the assembling of segments 26 for the resultant enlarged tunnel 27 is carried out by the following ring-type erector 29 comprising a stationary ring and a rotary ring which is rotatably supported in the stationary ring and is provided with chuck means 34.

The breaking means 28 comprises front and rear machine bodies 30, 31 which are connected one to another in mutually slidable relationship. The front machine body 30 is provided with supporting jacks 30*a*, 30*b* respectively projecting in the diametrical or lateral direction so as to be operable by oil pressure or the like. The rear machine body 31 is provided with supporting jacks 31*a*, 31*b* respectively projecting in the diametrical or lateral direction so as to be operable by oil pressure or the like so that the breaking means 28 may be fixedly supported by the jacks in an expanded condition and brought into contact with the surface of the liner 12.

Additionally, the breaking means 28 is provided with an advancing jack 32 bridged between the supporting jack 30*b* on the front machine body 30 side and the supporting jack 31*a* on the rear machine body 31 side. In this manner, if the advancing jack is contracted under a condition wherein the supporting jacks 30*a*, 30*b* on the front machine body 30 side are expanded and the supporting jacks 31*a*, 31*b* on the rear machine body 31 side are contracted, the rear machine body 31 is pulled toward the front machine body 30 side. Thereafter, if the advancing jack 32 is expanded under a condition wherein the supporting jacks 31*a*, 31*b* on the rear machine body 31 side are expanded and the supporting jacks 30*a*, 30*b* on the front machine body 30 side are contracted, the front machine body 30, and accordingly the breaking means 28 is advanced.

In addition, the breaking means 28 is provided with an arm 33 projecting therefrom so as to be expansible and contractible and also turnable by a jack, a motor or the like. A rotary cutter 33*a* is attached to the forward end of the arm 33 so that the tubular liner 12 is broken into small pieces by the rotary cutter 33*a* under a condition wherein the breaking means 28 is supported as mentioned above.

Instead of the rotary cutter 33*a*, any other desired breaking means such as the water pressure or the like as mentioned above may be used.

In the above two examples, the inner surface of the segment liner assembly 26 around the enlarged tunnel 27 may be applied with a secondary liner made of concrete or the like.

Figure 7A:
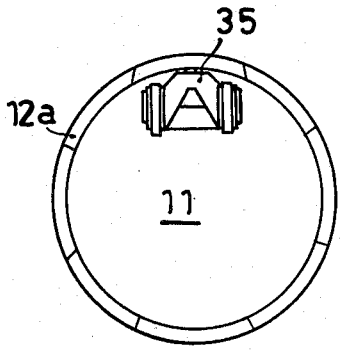
FIGS. 7A and 7B are front and rear views viewed from the lines A—A and B—B in FIG. 7.
Figure 7B:
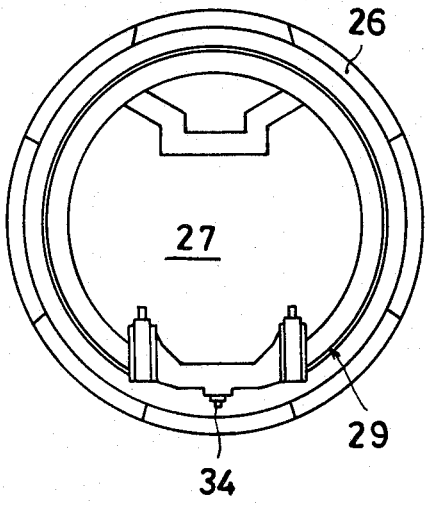
Figure 7:
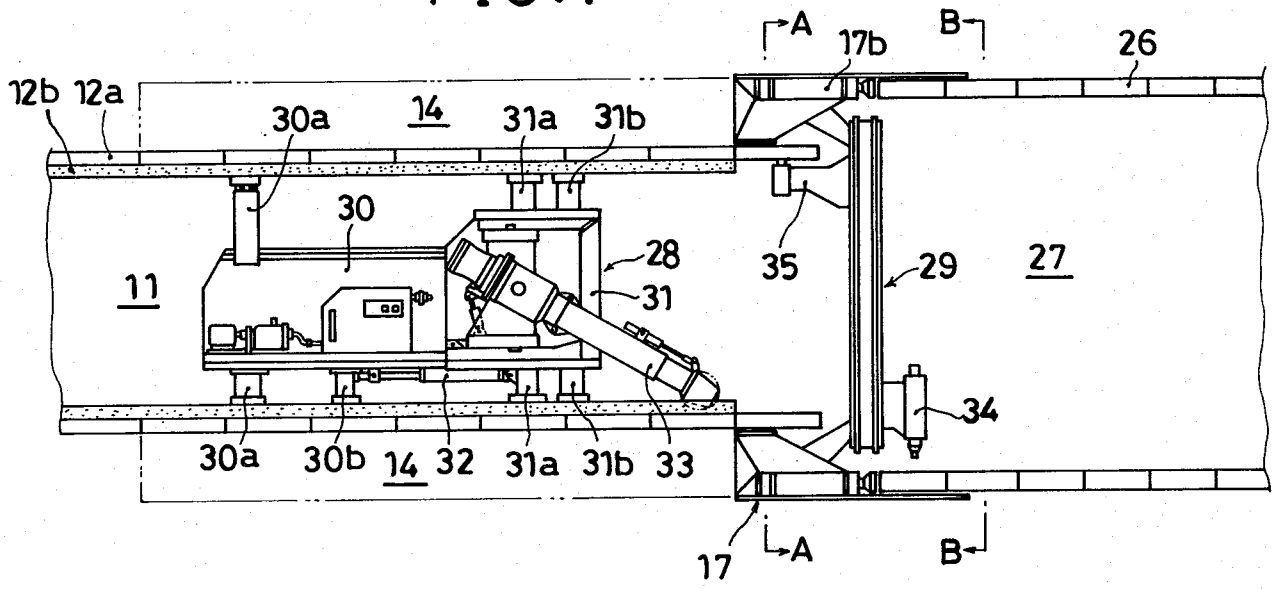
FIG. 7 is a sectional view for explaining a third example of the present invention.

A third example of the present invention will be explained with reference to FIGS. 7, 7A and 7B. This example is adaptable to an existing tunnel 11 lined with a first tubular liner 12*a* formed of segment assemblies and a second tubular liner 12*b* formed of concrete pipes or the like.

The ring type assembling erector 29 is provided with another chuck means 35 attached on the front side of the rotary ring in addition to the foregoing chuck means 34 on the rear side thereof.

Breaking of the second tubular liner 12*b* is carried out in the shield machine 17 in the same manner as in the foregoing second example. Thereafter, each segment of the tubular liner 12*a* is removed by the front chuck means 35. The resultant enlarged tunnel 27 is lined with the segments 26 by the rear chuck means 34. If desired, in this example, a second liner may be formed on the circumferential surface of the segment liner 26.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for constructing an enlarged tunnel wherein a portion of a predetermined region of an existing tunnel to be enlarged is circumferentially enlarged by the following steps:

excavating to form a circumferentially enlarged portion defining a starting base for a shield machine;

positioning a shield machine in the circumferentially enlarged portion;

cutting a tubular liner lining the existing tunnel into segment pieces;

advancing the shield machine forward along the existing tunnel in order to enlarge the circumference of the predetermined region of the existing tunnel;

removing those segment pieces of the liner of the existing tunnel; and circumferentially lining the resultant enlarged tunnel portion with segments.

2. A method for constructing an enlarged tunnel according to claim 1, and further including the following steps:

positioning a guide rail to extend through a section of the existing tunnel to be enlarged;

said cutting step includes the mounting of a cutting means on said rail for cutting said tubular liner.

3. A method for constructing an enlarged tunnel according to claim 1, wherein said cutting of the tubular liner is performed within said shield machine.

4. A method for construction an enlarged tunnel according to claim 2, wherein said cutting of the tubular liner is performed within said shield machine.

5. An apparatus for constructing an enlarged tunnel comprising:

cutting means for cutting a tubular liner lining an existing tunnel;

removing means for removing cut pieces of the tubular liner;

a shield machine for enlargement of the existing tunnel, said shield machine being assembled and disassembled within said enlarged tunnel and being provided with an excavating means for excavating the enlarged tunning and a jack means for advancing the shield machine along the enlarged tunnel; and an assembling means for applying segments to the inner circumferential surface of the circumferentially enlarged portion.

6. An apparatus according to claim 5, and further including a support rail for supporting said cutting means and said removing means, said cutting means and removing means being operatively positioned and selectively advanced along said support rail.

7. An apparatus according to claim 5, wherein said jack means selectively advances said shield machine along the enlarged tunnel.

8. An apparatus according to claim 5, wherein said cutting means is a flame jet.

9. An apparatus according to claim 5, wherein said cutting means is a laser beam.

10. An apparatus according to claim 5, wherein said cutting means is a microwave beam.

11. An apparatus according to claim 5, wherein said cutting means is a water jet.

12. An apparatus according to claim 5, wherein said cutting means is a cutting arm.

13. An apparatus according to claim 5, wherein said removing means and said assembling means are constructed into a ring-type ejector comprising a stationary ring and a rotary ring which is rotatably supported in the stationary ring and is provided with a first chuck which is attached on the front side of the rotary ring for removing the cut segment pieces of the tubular liner and with a second chuck which is attached on the rear side thereof for applying segments to the inner circumferential surface of the circumferentially enlarged portion.

* * * * *